US009486041B2

(12) United States Patent
Barbazza

(10) Patent No.: US 9,486,041 B2
(45) Date of Patent: Nov. 8, 2016

(54) JEWELLERY ITEM

(71) Applicant: Roberto Barbazza, Monte-Frazione di Valenza (IT)

(72) Inventor: Roberto Barbazza, Monte-Frazione di Valenza (IT)

(73) Assignee: BARBAZZA FRATELLI S.A.S. DI BARBAZZA ROBERTO E C., Valenza (AL) (IT)

( * ) Notice: Subject to any disclaimer, the term of this patent is extended or adjusted under 35 U.S.C. 154(b) by 0 days.

(21) Appl. No.: 14/582,277

(22) Filed: Dec. 24, 2014

(65) Prior Publication Data

US 2016/0183643 A1 Jun. 30, 2016

(51) Int. Cl.

| | |
|---|---|
| ***A44C 5/06*** | (2006.01) |
| ***A44C 9/02*** | (2006.01) |
| ***A44C 5/00*** | (2006.01) |

(52) U.S. Cl.

CPC ..... *A44C 5/06* (2013.01); *A44C 5/0069* (2013.01); *A44C 9/02* (2013.01)

(58) Field of Classification Search

CPC ..... A44C 5/06; A44C 5/0069

USPC ..... 63/5.1, 9

See application file for complete search history.

(56) References Cited

U.S. PATENT DOCUMENTS

| | | | | | |
|---|---|---|---|---|---|
| 2,032,831 | A * | 3/1936 | Blackinton | A44C 5/06 | 59/69 |
| 2,756,560 | A * | 7/1956 | Shahum | A44C 5/06 | 59/79.1 |
| 2,790,302 | A * | 4/1957 | Minematsu | A44C 5/06 | 59/79.1 |
| D213,462 | S * | 3/1969 | Casorati | 63/5.1 | |
| 3,490,227 | A * | 1/1970 | Kian | A44C 5/06 | 59/79.1 |
| 9,010,147 | B2 * | 4/2015 | Barbazza | A44C 5/06 | 63/38 |
| 2014/0000313 | A1 * | 1/2014 | Barbazza | A44C 5/06 | 63/4 |

FOREIGN PATENT DOCUMENTS

| | | | | |
|---|---|---|---|---|
| EP | 1911366 A1 * | 4/2008 | A44C 5/06 | |
| FR | 1156937 A * | 5/1958 | A44C 5/06 | |
| WO | WO 2012127511 A1 * | 9/2012 | A44C 5/06 | |

* cited by examiner

*Primary Examiner* — Emily Morgan

(74) *Attorney, Agent, or Firm* — Themis Law

(57) ABSTRACT

A jewellery item, or a gold, silver, or costume jewellery item, accessories and the like include an annular band having a predetermined width and a plurality of modular elements of an elongated shape, at least one of the modular elements being connected to at least three additional modular elements by at least three connection points, the modular elements being hinged with each other about each connection point such that the jewellery item is adjustable between a contracted condition and an extended condition, wherein the width has different values along the overall extension of the jewellery item.

15 Claims, 8 Drawing Sheets

JEWELLERY ITEM

FIELD OF THE INVENTION

The present invention relates to a jewellery item having an annular band of a predetermined width that includes a plurality of modular elements of an elongated shape, at least one of the modular elements being connected to at least three additional modular elements by at least three connection points, the modular elements being hinged to each other about each connection point such that the jewellery item is adjustable between a contracted condition and an extended condition.

Therefore, the jewellery item includes a plurality of modular elements connected to each other in a hinged manner, such to make the dimensions of the jewellery item variable.

The jewellery item can develop on a flat or arcuate surface, or preferably on an annular surface, and can be closed on itself to form a ring, a bracelet, or the like.

When the jewellery item is composed of an annular band, the term width means the axial width, which is measurable in the direction of the wearing axis. The modular elements are hinged to each other according to radial axes about each connection point, that is, axes perpendicular to the wearing axis.

BACKGROUND OF THE INVENTION

Jewellery items with variable dimensions are presently known, and, for example, are described in documents DE 9100430 or EP 1911366.

Those documents describe jewellery items that, passing from a closed (or contracted) condition to an open (or extended) condition, vary the dimensions of the item.

However, those items have the drawback that, in the open condition, they are fragile, that is, prone to changes when in use or to breakage in the event of an impact.

Moreover, although they are aesthetically pleasant in the closed condition, they are not aesthetically satisfactory in the open position.

Another drawback of those known elements is that, because they are not very strong, they can hardly maintain intermediate positions between the maximum and the minimum positions, but exhibit a tendency of acquiring alternatively one of these two positions, ending up not having the desired dimensions.

Moreover, those items usually have housings for gems, stones, or the like, which must all have the same dimension such that their overall dimensions can ensure the passage from the open condition to the closed condition.

However, the provision of gems with different dimensions is a much requested feature in jewellery items because of the aesthetic results deriving therefrom.

Therefore, there is presently an unsatisfied need for jewellery items having an overall variable dimension and gems of different dimensions.

SUMMARY OF THE INVENTION

An object of the present invention, therefore, is to provide a jewellery item of variable dimensions, which is strong and aesthetically pleasant even in an open or extended condition.

Another object of the present invention is to make the jewellery item suitable for different users in terms of dimensions and taste.

Still another object of the present invention is to provide a high aesthetic result and make it possible to use gems of different dimensions.

These and other objects are achieved by a jewellery item as described hereinafter, and in which the width can have different values along the overall extension of the item.

This makes it possible for the jewellery item to have a variable profile all along its extension, and, therefore, to house bigger gems in the wider portions.

In one embodiment, the width progressively varies from a maximum value to a minimum value.

This provides for a high aesthetic result due to a gradual increase in width. The combination of such features, therefore, provides for a jewellery item which is strong and aesthetically pleasant in every arrangement thereof.

In a further example, the maximum value and the minimum value of the width are provided at two diametrically opposite positions.

Thus the item progressively gets narrower from the point corresponding to the maximum width to the point of minimum width, which is provided diametrically opposite to the point with the maximum width.

In one embodiment, there is provided a single maximum value and a single minimum value, but in non-diametrically opposite positions.

In one embodiment, there are provided periodic changes in the width between the maximum value and the minimum value such to form two border lines of the annular band with a wave pattern.

The number of waves can be selected as one desires before being produced.

In a particularly advantageous embodiment, the connection point of two modular elements hinged with each other in the central area is provided in an eccentric position with respect to the length of each element, such that as the size of the angles defined by the intersection of the two modular elements and diametrically opposite along the longitudinal direction varies. The distance between the two first free ends of the two modular elements facing a first direction with respect to the longitudinal direction varies differently than the distance between the two other free ends of the two modular elements facing the direction opposite to said first direction.

The longitudinal direction is the one perpendicular to the width or, in the case of an annular band, perpendicular to the wearing axis, that is, to the circumferential direction.

The eccentricity of the central connection point provides for a pair of modular elements hinged to each other in such connection point, for the same opening angle, to cover a wider range on a first side than on the opposite side with reference to the connection point. Linking the modular elements hinged to each other provides for an increase in the width along the direction where the distance between the two free ends of the two modular elements is greater. The eccentricity can be defined in the designing step: a greater eccentricity causes the width to vary more rapidly, while a lower eccentricity causes the width to increase more gradually.

In one improvement, the elements are provided in pairs of two with the same lengths, the modular elements of each pair being hinged to each other at the central area and the additional modular elements, connected to the pair, having a length different than the length of the modular elements of the pair.

This, together with the above eccentricity feature, provides for a continuous variation of the width along the extension of the item.

This does not apply to the modular elements placed at the positions of maximum or minimum width value, and, therefore, applies to the modular elements provided in the intermediate areas between the maximum and minimum width values, along the extension of the jewellery item. At the maximum and minimum width values there are provided two pairs of elements hinged to each other in symmetric manner.

In one embodiment, in each modular element the connection points comprise through holes.

The modular elements are connected to each other at said connection points by pivot pins.

There are provided housings intended to receive gems or other decorative elements.

The housings are placed at said connection points.

Advantageously, said housings are at each connection point.

This provides for changing the dimensions of the gems provided at the different connection points, in a manner corresponding to the dimensions of the shape of the modular element around the through holes.

In one embodiment, the jewellery item is a ring and the gems in the ring areas intended to be placed between the fingers or in the area of the ring facing the palm have dimensions that not to preclude from normally and confidently closing the fingers. This provides the ring with a pleasant wearability. Preferably, the ring is intended to be worn to have the point of minimum width faced toward the palm of the hand and the point of maximum width faced towards the back of the hand. This enables providing small gems to at the point of minimum width, that is, toward the palm of the hand, and gems of increasing dimension increasing toward the point of maximum width, that is, towards the back of the hand. Thus, a continuous and gradual aesthetic effect is provided.

In an improvement, in one modular element the shape about the through hole of a connection point placed at the end of the modular element, facing a first direction with respect to the longitudinal direction, has a dimension different than the shape about the through hole of a connection point placed at the opposite end of the modular element, facing the direction opposite to said first direction.

Similarly, the through holes placed at the opposite ends of the modular element can be different from each other.

The gems associated to a modular element thus are not equal to each other, but have different dimensions.

In one improvement, the holes at different positions along the extension of the item have a dimension that is different from one another, and that dimension changes proportionally with the width.

This allows providing gems of a larger and larger dimension as the width increases. Thus the biggest gems are provided at the maximum width value or values.

In one embodiment, at least one of the modular elements comprises at least three connection points for the connection to three additional modular elements, the connection point being intended to connect the at least one modular element of an additional modular element and at least one intermediate portion, interposed between a first connection point for the connection to a first additional modular element and a second connection point for the connection to a second additional modular element of the three connection points.

Such intermediate portion is arranged to allow interposing a fourth additional modular element between the first additional modular element and the second additional modular element.

The modular element is connected to the three additional modular elements and is operatively coupled to the fourth additional modular element.

The interposition of an additional modular element, operatively associated to the modular element, between the two additional modular elements connected to the same modular element, helps in creating a compact structure with a high resistance to impacts and deformations and aesthetically pleasant, and allows reducing its extension as desired.

In a preferred embodiment of the invention, the intermediate portion comprises an additional connection point for the connection to the fourth additional modular element and, therefore, the jewellery item is connected to the four additional modular elements.

Thus the jewellery item is even more resistant and can be less extendable.

The modular elements can be partly equal to each other and the additional modular elements can be partly equal to each other and/or equal to the modular elements.

In another embodiment, said intermediate portions are two: a first one interposed between the first connection point for the connection to a first additional modular element and the second connection point for the connection to a second additional modular element, arranged to allow interposing the fourth additional modular element between said first additional modular element and said second additional modular element; and a second one interposed between the second connection point for the connection to a second additional modular element and a third connection point for the connection to a third additional modular element, arranged to allow interposing a fifth additional modular element between said second additional modular element and said third additional modular element.

Thus the modular element is connected to the five additional modular elements.

In one embodiment, one or more of the modular elements have at least one bend in at least one connection point such that the two parts of the element opposite to each other with respect to the bend are not aligned with each other.

In another embodiment, the modular element has widenings at the connection points, such that in the contracted condition and in the extended condition respectively the borders of said widenings are each placed at a narrowing comprised between two widenings in an adjacent modular element.

The pins may be welded to the modular elements placed along a lower plane, that is, in the case of an annular band, those placed along the inner circumference, or to those placed along an upper plane, that is, in the case of an annular band, those placed along the outer circumference.

BRIEF DESCRIPTION OF THE DRAWINGS

These and other characteristics and advantages of the present invention will be clearer from the following description of a few embodiments shown in the enclosed drawings, wherein.

DETAILED DESCRIPTION OF EMBODIMENTS OF THE INVENTION

FIGS. 1 to 5 show a first embodiment of a jewellery item according to the invention, generally denoted by reference number 1.

The jewellery item 1 comprises a plurality of modular elements 2. At least one of said modular elements 2 comprises at least three connection points 3*a*, 3*b*, 3*c* for the connection to three other modular elements 2*a*, 2*b*, 2*c*.

The combination of the above features enables the modular elements 2 to vary their mutual positions passing from a contracted condition where, in case of circular shaped items, such as (by way of example and not of limitation) a ring, a bracelet or a strap, the diameter is minimum, to an extended condition where the diameter is maximum. The item can be produced with a flat or arcuate arrangement, and it can be used for example as a hanging ornament, a pendant, a key ring or as an earring.

Figure 1:
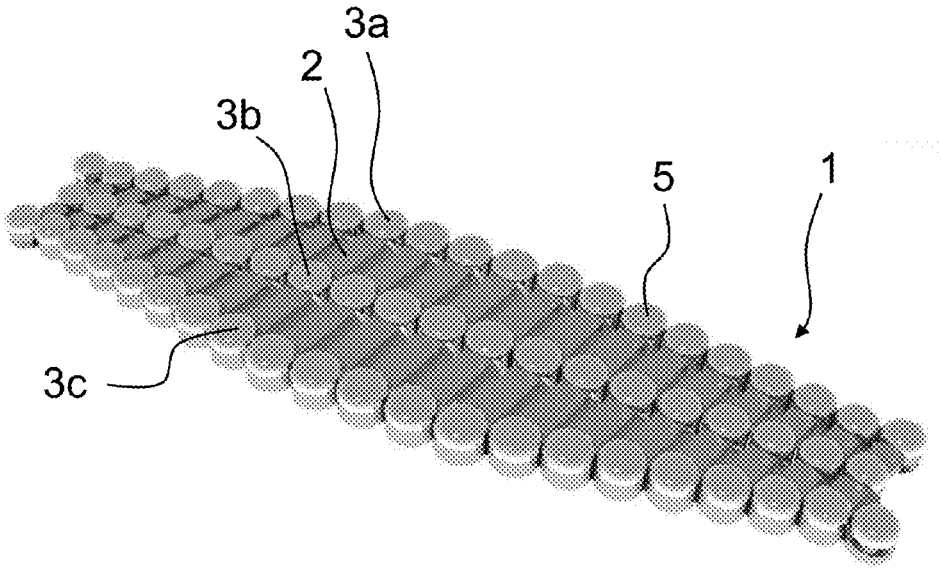
FIGS. 1 and 2 are two different views of a first embodiment in the contracted condition.
Figure 2:
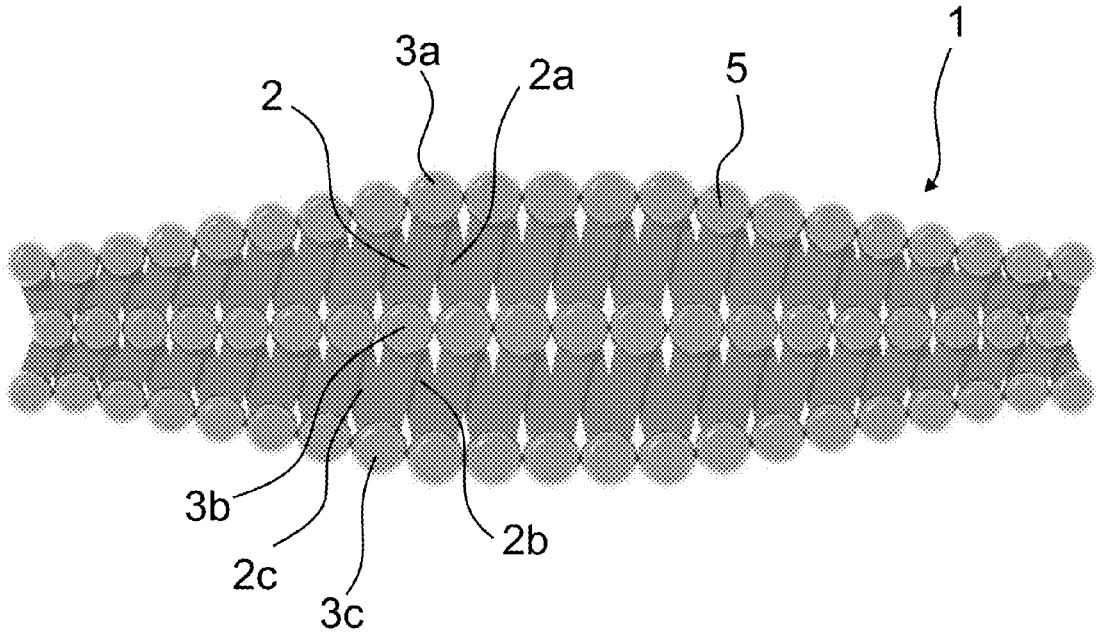
Figure 3:
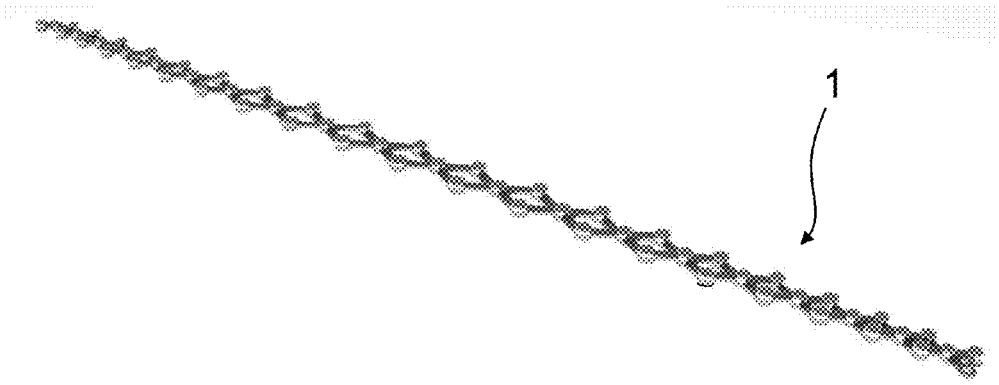
FIGS. 3 and 4 are two different views of the first embodiment in the extended condition.
Figure 4:
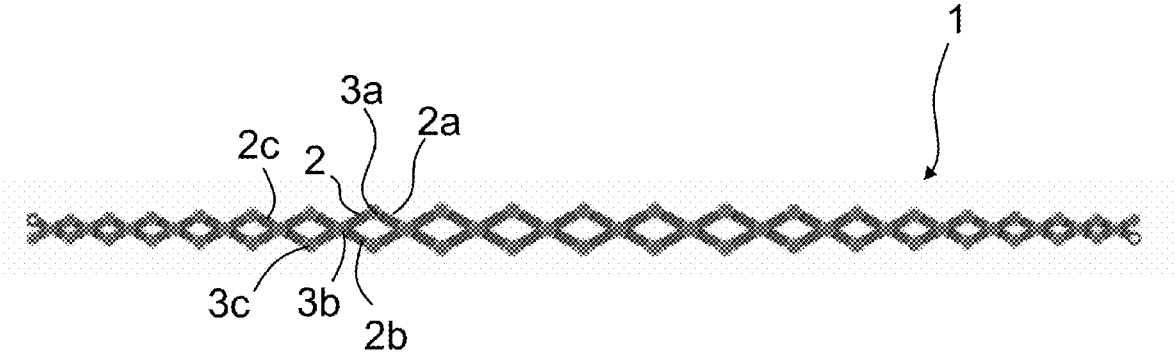

The contracted condition is shown in FIGS. 1 and 2, while the extended condition is shown in FIGS. 3 and 4.

The passage from the contracted condition to the extended condition and vice versa can be modulated, therefore, the item 1 can take all the intermediate positions between these two extreme positions and can remain in intermediate positions, due to the specific arrangement of the strengths in the structure.

The modular element 2 comprises three substantially circular portions, coincident with the connection points 3*a*, 3*b*, and 3*c*, which are connected to each other by two straight intermediate portions to form an elongated element. The intermediate portions can also be curvilinear.

Therefore, the annular jewellery item 1 is composed of an annular band of a predetermined width comprising said modular elements 2, which have an elongated shape and which are hinged to each other about each connection point 3*a*, 3*b*, 3*c*.

As it can be seen in the figures, said width has different values along the overall extension of the jewellery item 1, and this can be noted both in the contracted condition in FIGS. 1 and 2 and in the extended condition in FIGS. 3 and 4.

Said width varies between a maximum value and a minimum value in a progressive manner and the maximum value and the minimum value of said width are provided at two diametrically opposite positions.

In the case of a ring, the minimum width can be provided in the ring portion facing the palm of the hand, while the maximum width in the portion facing the back of the hand.

It is possible to provide for periodic changes in the width between the maximum value and the minimum value, such to form two border lines of the annular band with a wave pattern.

Figure 5:
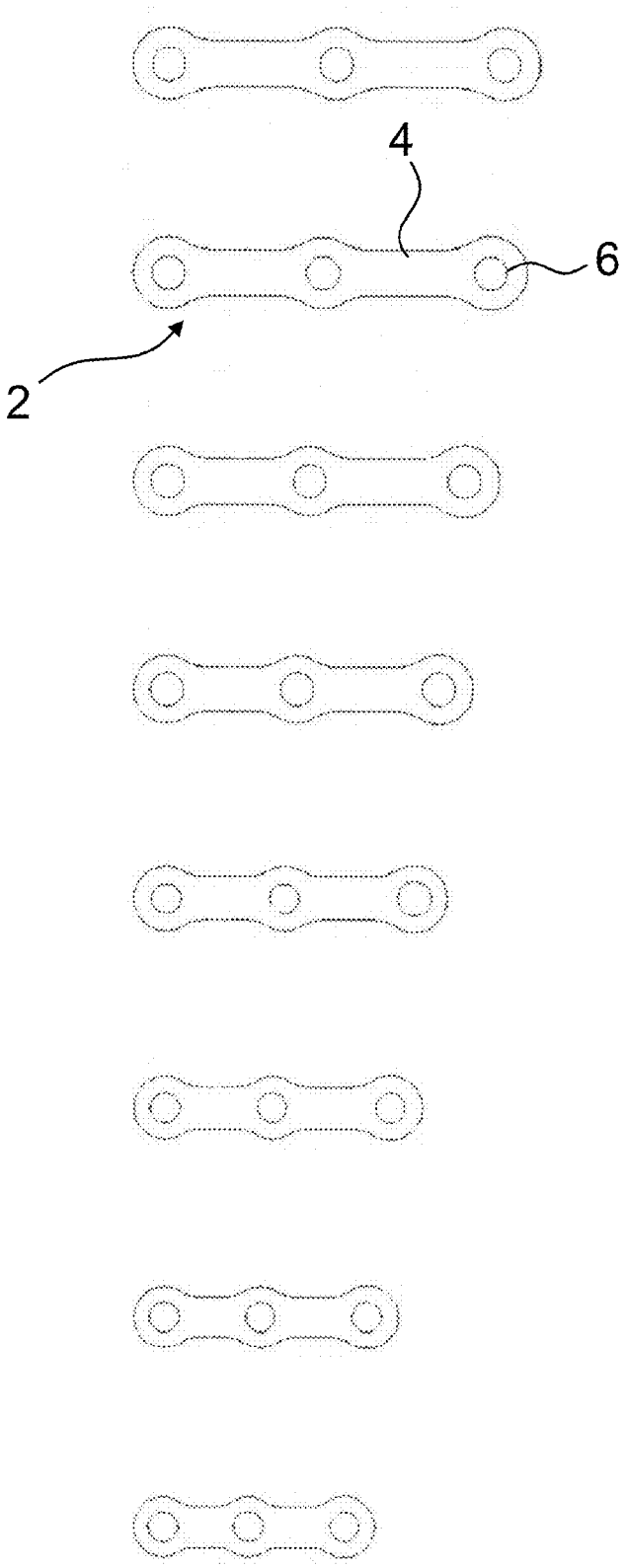
FIG. 5 shows a few of the modular elements of the first embodiment in the disassembled condition.

As it can be noted in FIGS. 1 to 5, and particularly in FIG. 5, the connection point of two modular elements 2 hinged to each other in the central area is provided in an eccentric position with respect to the length of each element 2.

Thus, as the size of the angles defined by the intersection of the two modular elements 2*a* and 2*b* and diametrically opposite along the longitudinal direction varies, the distance between the two free ends of the two modular elements 2 and 2*b* facing a first direction with respect to the longitudinal direction varies differently than the distance between the two free ends of the two modular elements 2 and 2*b* facing the direction that is opposite to said first direction.

The eccentricity of the central connection point 3*b* provides for a pair of modular elements 2 and 2*b* hinged to each other at connection point 3*b*, for the same opening angle, to cover a wider range on a first side than on the opposite side with reference to the connection point.

Linking the modular elements 2 hinged to each other causes an increase in the width along the direction where the distance between the two free ends of the two modular elements is greater.

This does not apply to the modular elements 2 placed at the positions of maximum or minimum width value, and, therefore, applies for the modular elements 2 provided in the intermediate areas between the maximum and minimum width values, along the extension of the jewellery item 1.

FIG. 5 shows how the modular elements are provided with a progressively increasing length.

The modular elements 2 and 2*b* are provided in pairs of two with the same length, the modular elements of each pair being hinged to each other at the central connection point 3*b* and the additional modular elements 2*a* and 2*c*, connected to the pair, having a length that is different than the length of the modular elements of the pair.

This, together with the above described eccentricity feature, provides for a continuous change of width along the extension of the item.

Each of said circular portions comprises a through hole 6 configured to connect the modular element 2 with additional modular elements 2*a*, 2*b* and 2*c* by means of pivot pins placed in said connection points.

There are further provided housings 5 intended to receive gems or other decorative elements such as, for example, closing caps, which can be suitably machined.

Such housings 5 are preferably integral with the corresponding pivot pins.

In this case, the holes 6 provide also for aligning such housings 5.

The through holes 6 can have different shapes, depending on need.

The housings 5 can be provided at each connection point 3*a*, 3*b*, 3*c* or only in a part thereof.

The jewellery item 1 preferably is a ring, but it can be any annular ornament of known type and with any shape (flat, concave, convex, curvilinear, etc.).

As it can be seen in the figures, where the annular band is shown open and arranged on a first plane, the modular elements 2 lie all on the same plane and said additional modular elements 2*a*, 2*b*, 2*c* lie all on a same second plane, which second plane is parallel to the first plane.

In each modular element 2 the shape about the through hole 6 of a connection point placed at the end of the modular element, that end facing a first direction with respect to the longitudinal direction, has a dimension different than the shape about the through hole 6 of a connection point placed at the opposite end of the modular element, facing the direction opposite to said first direction.

The gems associated to a modular element are not thus equal to each other, but they have different dimensions.

The shapes around the holes 6 in different positions along the extension of the item 1 have a dimension that is different from each other, and such dimension varies proportionally to said width.

This provides for having gems of larger and larger dimensions as the width increases. Thus, the biggest gems are provided at the maximum width value or values.

According to the present invention, the jewellery item 1 can further comprise at least one intermediate portion 4, interposed between a first connection point 3*a* and a second connection point 3*b* of said three connection points 3*a*, 3*b*, 3*c*.

Such intermediate portion 4 is arranged to enable interposing an additional fourth modular element 2*b* between said first further modular element 2*a* and said second further modular element 2*b*.

In other words, a modular element 2 comprises at least four portions, having three connection points or portions and one portion for the interposition of further modular elements.

The modular element 2 is connected to the three additional modular elements 2*a*, 2*b*, 2*c* and it is operatively associated to a fourth additional modular element.

Such configuration enables obtaining a quadrilateral system with hingeable corners that are mutually constrained not only at the corners but also at other intermediate portions.

The intermediate portion 4 in this case can act as a bridge between two connection points 3*a*, 3*b* 3*c* and can let the additional fourth modular element 2*d* to slide thereon without being fastened thereto, or can comprise an additional connection point for connecting to said additional fourth modular element.

FIGS. 6 to 9 show a second embodiment, wherein two intermediate portions 4 are provided.

A first intermediate portion 4 is interposed between the first connection point 3*a* and the second connection point 3*b* and it is arranged to allow interposing a fourth further element 2*b* between the first additional element 2*a* and the second additional element 2*b*.

A second intermediate portion 4 is interposed between the second connection point 3*b* and the third connection point 3*c* and is arranged such to allow a fifth additional modular element 2*e* to be interposed between the second additional element 2*b* and the third additional element 2*c*.

Particularly, the modular element 2 comprises five circular portions arranged along an axis such to form an elongated element.

Each one of those circular portions comprises a through hole 6 intended to connect the modular element 2 with additional modular elements 2*a*, 2*b*, 2*c*, 2*d*, and 2*e* by means of pivot pins.

However, the modular element 2 is not necessarily connected in five points with additional modular elements 2*a*, 2*b*, 2*c*, 2*d*, 2*e* but the intermediate portions 4 can or cannot have connection points.

Figure 6:
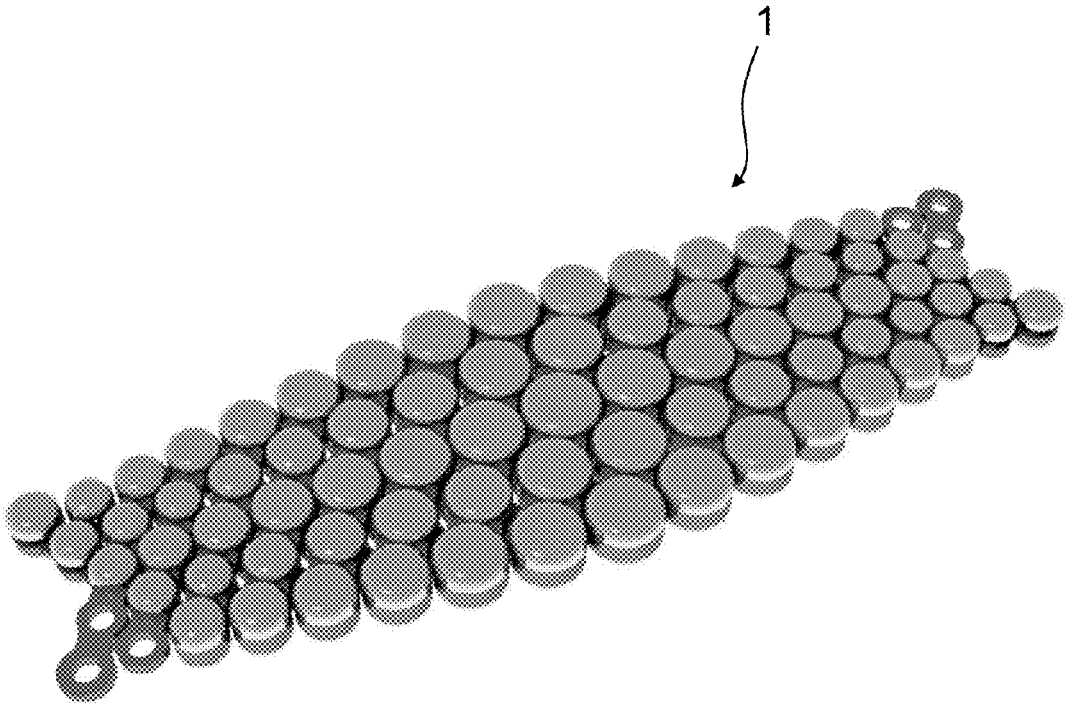
FIGS. 6 and 7 are two different views of a second embodiment in the contracted condition.
Figure 7:
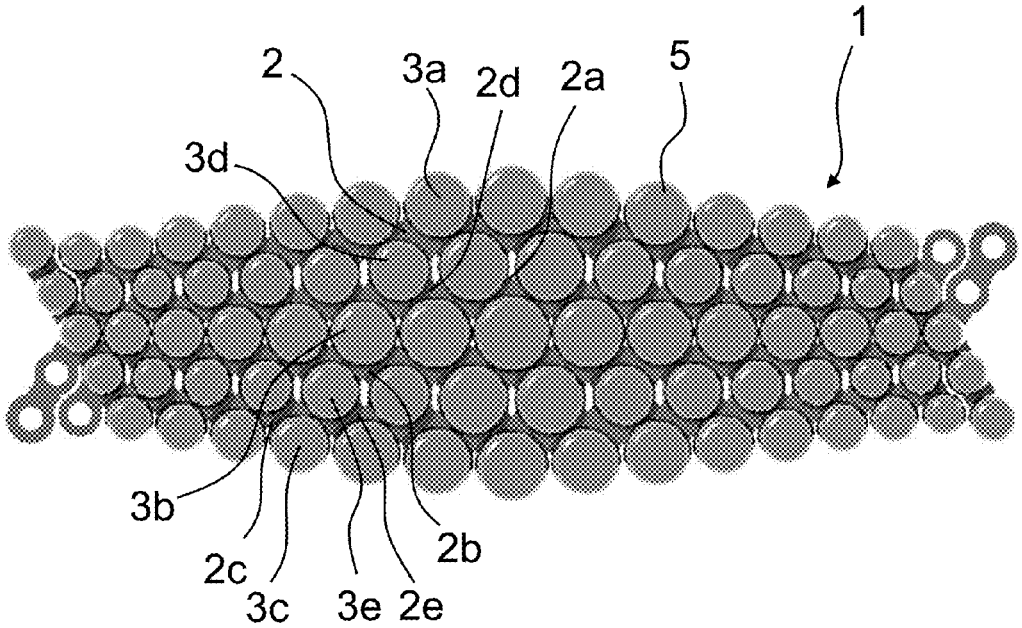
Figure 8:
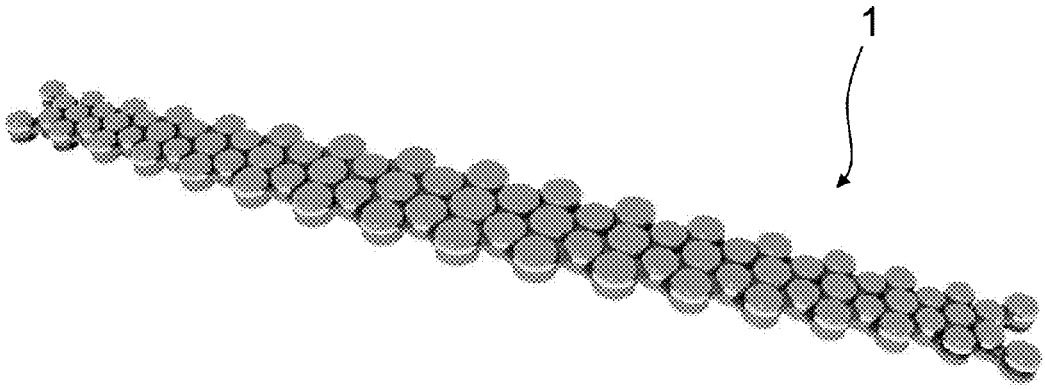
FIGS. 8 and 9 are two different views of the second embodiment in the extended condition.
Figure 9:
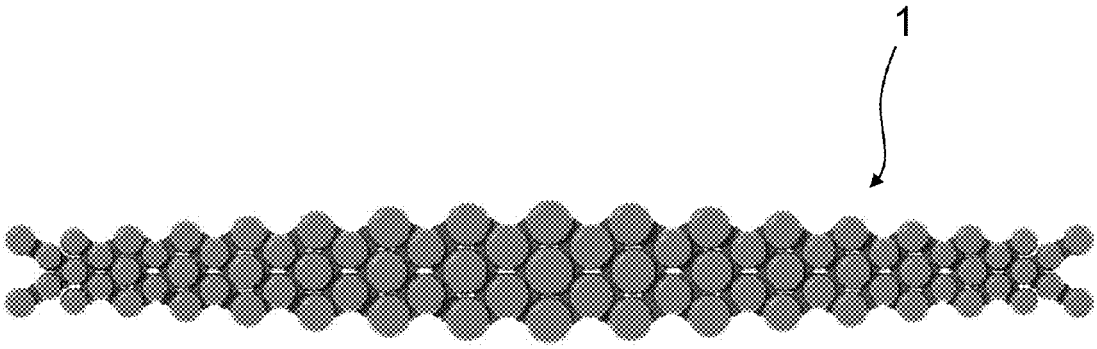

FIGS. 6 and 7 show the jewellery item 1 in the contracted condition, while FIGS. 8 and 9 show it in the extended condition.

The modular element has widenings at the connection points, corresponding to said substantially circular areas, such that in the contracted condition and in the extended condition respectively the borders of said widenings are placed each one at a narrowing point comprised between two widenings in one adjacent modular element.

This allows minimizing empty spaces between the modular elements both in the extreme contracted condition of FIGS. 6 and 7, and in the extreme extended condition of FIGS. 8 and 9.

Figure 10:
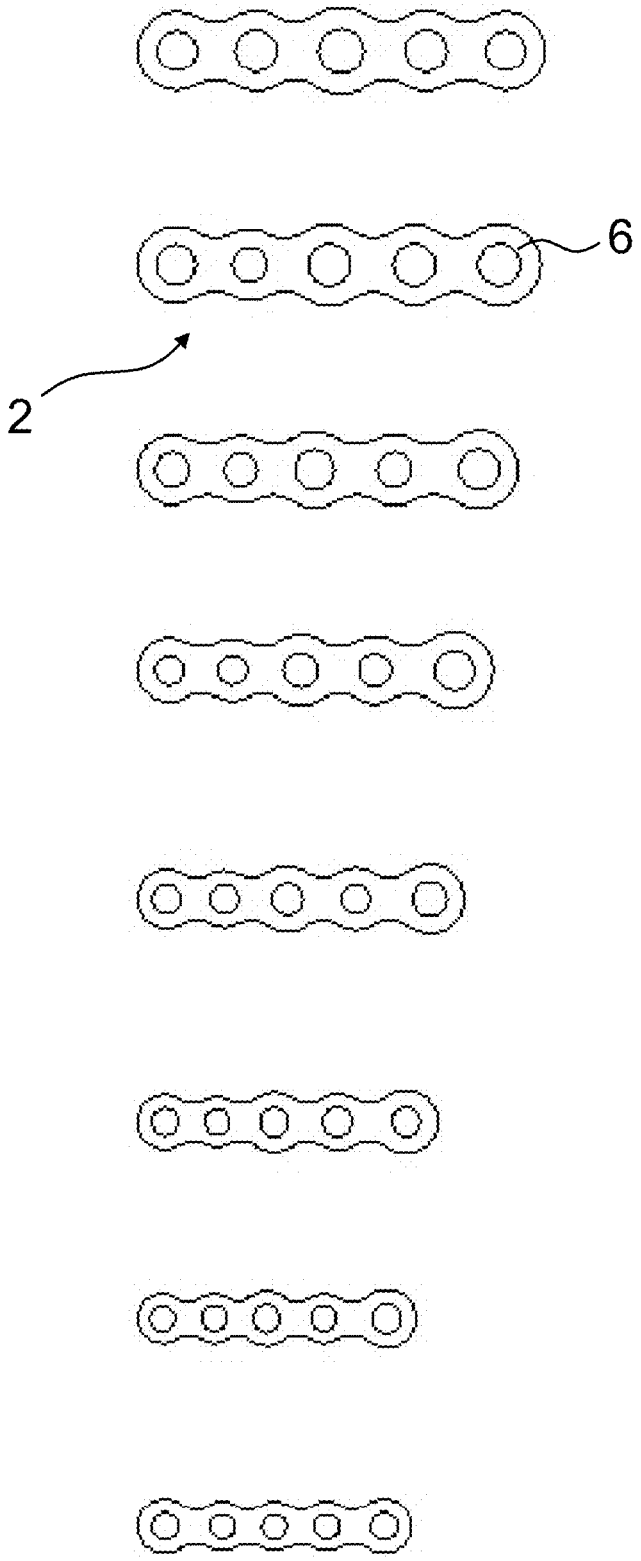
FIG. 10 shows a few of the modular elements of the second embodiment in the disassembled condition.

FIG. 10 shows the modular elements of the second embodiment in the disassembled condition. It is possible to see how the modular elements are each provided with five holes, and how they have an overall increasing length. The longest modular element and the shortest one are the maximum and minimum elements, and, therefore, they are hinged at the central hole to form symmetric pairs.

Figure 11:
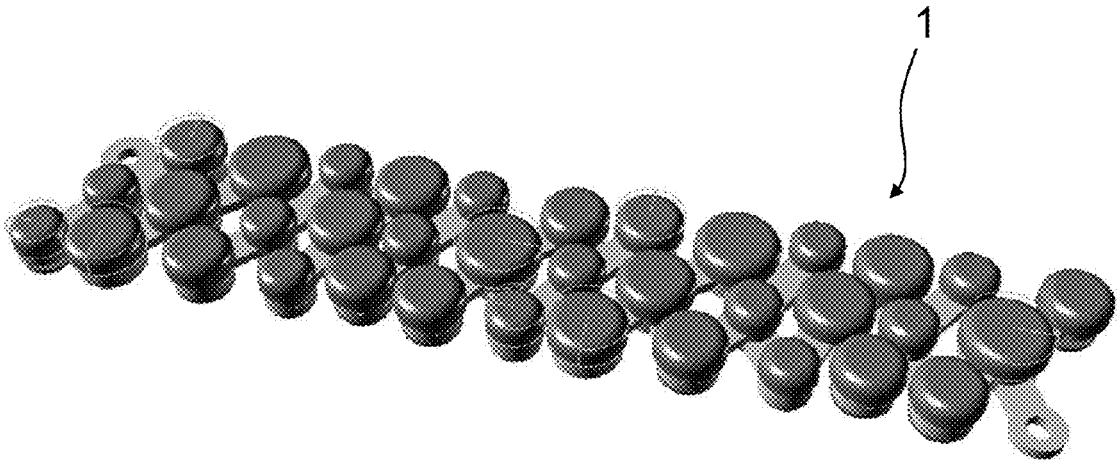
FIGS. 11 and 12 are two different views of a third embodiment.
Figure 12:
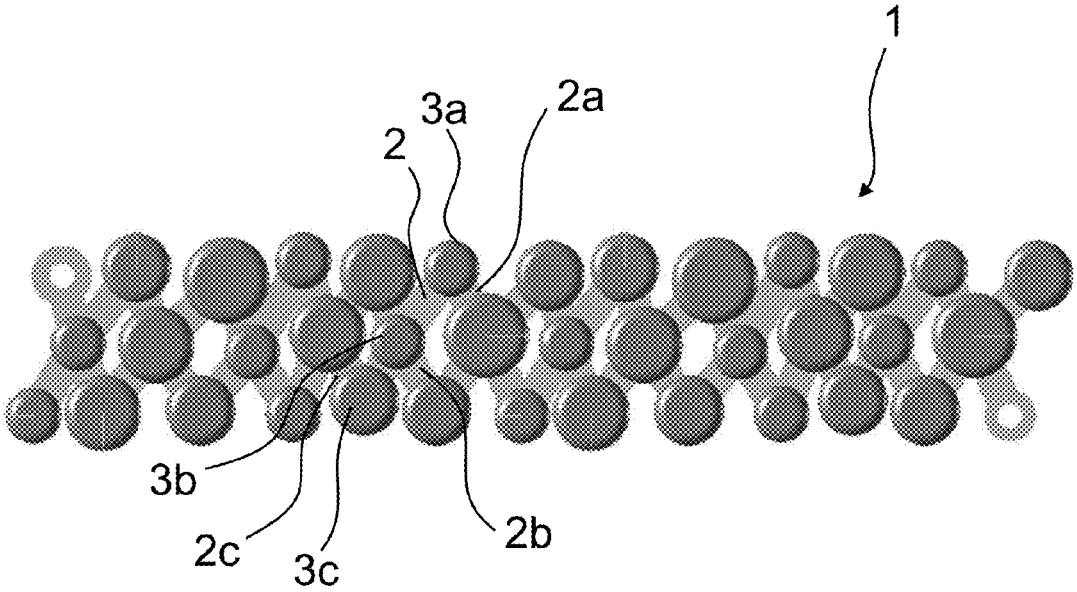

FIGS. 11 and 12 show a third embodiment, wherein one or more modular elements have at least one bend in at least one connection point, such that the two parts of the element opposite to each other with respect to the bend are not aligned with each other.

In the illustrated embodiment, each modular element 2 is connected with three additional elements. The parts of the element opposite to each other with respect to the central point, that is, with respect to the bend, correspond to the intermediate portions 4, and are not aligned with each other but form angles of different sizes.

Thus, an inhomogeneous structure is formed of a high aesthetic value, wherein spaces can be created for receiving gems of different dimensions, spread throughout the entire extension of the jewellery item 1.

The embodiment of FIGS. 11 and 12 can be arranged to comprise all or a part of the features mentioned in relation to the embodiments of FIGS. 1 to 10.

Figure 13:
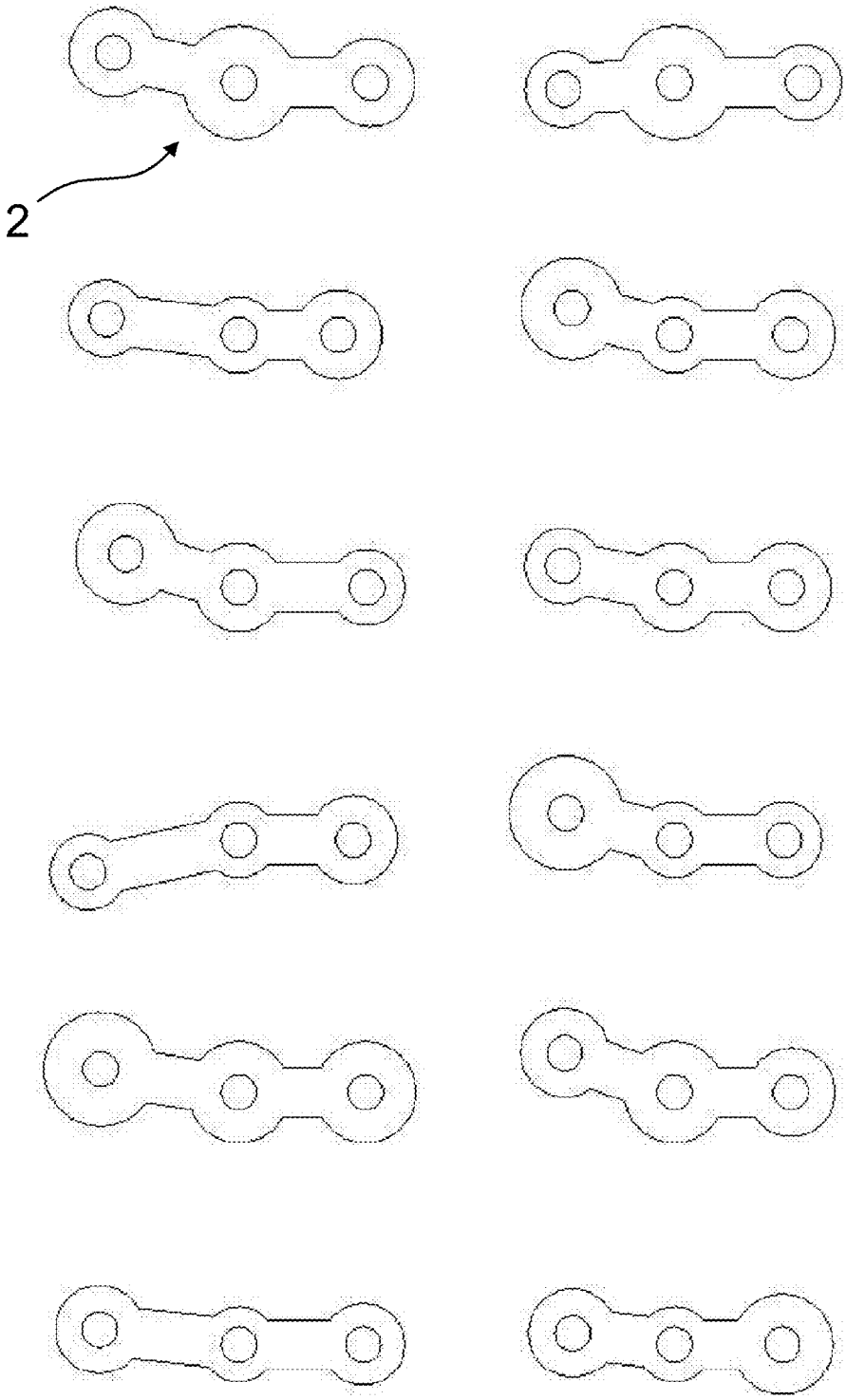
FIG. 13 shows the modular elements of the third embodiment in the disassembled condition.

FIG. 13 shows the elements of the third embodiment in the disassembled condition. Each element in the left column couples in the central hole in a hinged manner with the corresponding element in the right column.

The invention can be extended to jewellery items, gold, silver, costume jewellery items, accessories and the like without requiring modifications.

The jewellery item 1 can be made of any material deemed suitable.

While the invention has been described in connection with the above described embodiments, it is not intended to limit the scope of the invention to the particular forms set forth, but on the contrary, it is intended to cover such alternatives, modifications, and equivalents as may be included within the scope of the invention. Further, the scope of the present invention fully encompasses other embodiments that may become apparent to those skilled in the art and the scope of the present invention is limited only by the appended claims.

The invention claimed is:

1. A jewelry item (1) comprising:

a band having a width and comprising a plurality of modular elements (2), the modular elements having an elongated shape and a plurality of different lengths, wherein at least one of said modular elements (2) is connected to at least three additional modular elements (2*a*, 2*b*, 2*c*, 2*d*, 2*e*) at at least three connection points (3*a*, 3*b*, 3*c*, 3*d* 3*e*), the modular elements (2*a*, 2*b*, 2*c*, 2*d*, 2*e*) being hinged to each other about each connection point (3*a*, 3*b*, 3*c*, 3*d* 3*e*) such that the jewelry item (1) is adjustable between a fully contracted condition and a fully extended condition, wherein at least two of the plurality of modular elements have a same length and are hinged to each other at a central connection point, and wherein the modular elements having an elongated shape and a plurality of different lengths cause said width of said band to vary between a maximum width and a minimum width along an overall extension of the jewelry item (1) both when said band is in the fully contracted and is in the fully extended condition.

2. The jewelry item (1) according to claim 1, wherein said width progressively varies from a maximum value to a minimum value.

3. The jewelry item (1) according to claim 2, wherein the maximum value is at a central position of said band and the minimum value is at end positions of said band.

4. The jewelry item (1) according to claim 2, wherein there are provided changes in the width between the maximum and the minimum width such to form an annular band having upper and lower outer edges with a wave pattern.

5. The jewelry item (1) according to claim 2, wherein the at least one of said modular elements (2) has a angled shape defined by a central connection point disposed off a straight line connecting end connection points.

6. The jewelry item (1) according to claim 1, wherein in each modular element (2, 2*a*, 2*b*, 2*c*, 2*d*, 2*e*) the connection points comprise through holes (6).

7. The jewelry item (1) according to claim 6, wherein in one modular element (2, 2*a*, 2*b*, 2*c*, 2*d*, 2*e*) a shape about a through hole of a connection point placed at one end of the modular element, the end facing a first direction with respect to the longitudinal direction, has a dimension different than a shape about a through hole of a connection point placed at an opposite end of the modular element, facing a direction opposite to said first direction.

8. The jewelry item (1) according to claim 6, wherein the through holes (6) at different positions along an extension of the jewelry item have a dimension different from one another, and wherein said dimension changes proportionally with said width.

9. The jewelry item (1) according to claim 1, further comprising housings (5) configured to receive gems or other decorative elements.

10. The jewelry item (1) according to claim 9, wherein said housings (5) are placed at said connection points (3*a*, 3*b*, 3*c*, 3*d*, 3*e*).

11. The jewelry item (1) according to claim 1, wherein said modular elements (2, 2*a*, 2*b*, 2*c*, 2*d*, 2*e*) are connected to each other at said connection points by pivot pins.

12. The jewelry item (1) according to claim 1, wherein the modular element (2) is connected to four additional modular elements (2*a*, 2*b*, 2*c*, 2*d*).

13. The jewelry item (1) according to claim 1, wherein the modular element (2) is connected to five additional modular elements (2*a*, 2*b*, 2*c*, 2*d*, 2*e*).

14. The jewelry item (1) according to claim 1, wherein the modular element (2) is wider, in relation to a longitudinal axis of the modular element, at the connection points (3*a*, 3*b*, 3*c*, 3*d*, 3*e*), and narrower between the connection points, such that, respectively in the fully contracted condition and in the fully extended condition, borders of wider portions of the modular element are placed adjacently to narrower portions of a neighboring modular element (2*a*, 2*b*, 2*c*, 2*d*, 2*e*).

15. A jewelry item (1) comprising:

an annular band having a width and further having a plurality of modular elements (2, 2*a*, 2*b*, 2*c*, 2*d*, 2*e*) the modular elements having an elongated shape and a plurality of different lengths, wherein at least one of said modular elements (2) is connected to at least three additional modular elements (2*a*, 2*b*, 2*c*, 2*d*, 2*e*) by at least three connection points (3*a*, 3*b*, 3*c*, 3*d*, 3*e*), wherein the modular elements (2*a*, 2*b*, 2*c*, 2*d*, 2*e*) are hinged to each other about each connection point (3*a*, 3*b*, 3*c*, 3*d*, 3*e*) such that the jewelry item (1) is adjustable between a fully contracted condition and a fully extended condition, wherein the modular elements having an elongated shape and a plurality of different lengths cause the annular bend to have a plurality of widths both when the annular band is in the fully extended and is in the fully contracted condition, and wherein a plurality of the modular elements (2*a*, 2*b*, 2*c*, 2*d*, 2*e*) have at least one bend in at least one connection point (3*a*, 3*b*, 3*c*, 3*d*, 3*e*), such that two parts of the modular element opposite to each other with respect to the bend are not aligned with each other.

* * * * *